US006264072B1

(12) United States Patent
Johannes

(10) Patent No.: US 6,264,072 B1
(45) Date of Patent: Jul. 24, 2001

(54) FUNNEL ATTACHMENT FOR PAINT CANS

(76) Inventor: Shon Johannes, R.R. 1 Box 77, Powhattan, KS (US) 66527

( * ) Notice: Subject to any disclaimer, the term of this patent is extended or adjusted under 35 U.S.C. 154(b) by 0 days.

(21) Appl. No.: 09/436,174

(22) Filed: Nov. 8, 1999

(51) Int. Cl.[7] ..... B65D 88/26; B67C 11/00
(52) U.S. Cl. ..... 222/460; 222/562; 222/570
(58) Field of Search ..... 222/460, 461, 222/462, 552, 562, 570

(56) References Cited

U.S. PATENT DOCUMENTS 4,034,901 * 7/1977 Kirk ..... 222/570
4,239,130 * 12/1980 Altandonna ..... 222/460
5,467,888 * 11/1995 Brandstrom et al. ..... 222/570
5,720,408 * 2/1998 Schmid et al. ..... 222/570
5,893,489 * 4/1999 Giarrante ..... 222/570

* cited by examiner

*Primary Examiner*—Joseph A. Kaufman
(74) *Attorney, Agent, or Firm*—Michael I. Kroll

(57) ABSTRACT

The present invention 10 discloses a detachable funnel for attachment to the top of a conventional paint can 12. The funnel 10 has an elongated neck 20 being offset from center having a threadably attached top 22 on its orifice end. The top 22 has an auxiliary attachment to the neck 20 by a ring 30 having a lead 32 connecting the top 22 thereto. A tab 24 is provided on the neck 20 to which the top 22 can be attached when not in use. The base of the funnel 10 has a lip member 26 thereon having a contoured downwardly extending protrusion 40 thereon for mating with the locking groove 42 of the paint can top. An alternative funnel 10 is disclosed having a centrally positioned, shortened neck 44.

3 Claims, 11 Drawing Sheets

FUNNEL ATTACHMENT FOR PAINT CANS

BACKGROUND OF THE INVENTION

1. Field of the Invention

The present invention relates generally to pouring attachments for cans and, more specifically, to an elongated offset funnel shaped attachment for paint cans having a rim for engaging the groove of a paint can and having a steel ring imbedded within the periphery edge of the cover portion of the funnel providing tensioning means for sealing said funnel to said can and further permitting repeated use of prying objects, such as screwdrivers to remove the funnel from the can without destroying the funnel.

Further said funnel having an external spiral thread around the throat of the funnel orifice providing engaging means for the threaded sealing means and said threaded sealing means having retaining means to prevent loss the sealing means. In addition, said funnel having positioning means for engaging the sealing means while the funnel is in use. Further the orifice formed by the engaging lip of the funnel has the substantially identical diameter as that of the orifice formed by the groove of the can whereby the two orifices, being identical, seal the mating surfaces, preventing paint from entering said seal thereby when the paint is poured from the can using the funnel the paint which adhered to the sides of the funnel will drip back into the paint can. In addition the mating of the funnel to the can will prevent any paint from pouring down the exterior of the can. This becomes a serious issue as most colored paints are now mixed and a label is attached showing the exact amounts of each colored needed to duplicate the desired color.

Also shown is the funnel having an alternate configuration for the positioning and length of the funnel. Whereby said funnel has a shortened centrally located funnel shaped attachment for paint cans having a rim for engaging the groove of a paint can and having a steel ring imbedded within the periphery edge of the cover portion of the funnel providing tensioning means for sealing said funnel to said can. Further said funnel having an external spiral thread around the throat of the funnel orifice providing engaging means for the threaded sealing means and said threaded sealing means having retaining means to prevent loss of the sealing means. In addition, said funnel having positioning means for engaging the sealing means while the funnel is in use. Further the orifice formed by the engaging lip of the funnel has the substantially identical diameter as that of the orifice formed by the groove of the can whereby the two orifices, being identical, seal the mating surfaces, preventing paint from entering said seal thereby when the paint is poured from the can using the funnel the paint which adhered to the sides of the funnel will drip back into the paint can.

2. Description of the Prior Art

There are other funnel devices designed for attachment to can to aid in pouring. Typical of these is U.S. Pat. No. 3,750,722 issued to Nowak on Aug. 7, 1973.

Another patent was issued to Sevier on Jun. 8, 1897 as U.S. Pat. No. 584,275. Yet another U.S. Pat. No. 5,031,804 was issued to Conrad on Jul. 16, 1991 and still yet another was issued on Aug. 3, 1971 to Munn as U.S. Pat. No. 3,596,813.

Another patent was issued to Hayduchok on Mar. 1, 1977 as U.S. Pat. No. 4,099,802. Yet another U.S. Pat. No. 5,803,140 was issued to Jodoin on Sep. 8, 1998.

U.S. Pat. No. 3,750,722, Inventor: Roger I. Nowak, Issued: Aug. 7 1973.

A funnel having a flange adapted to fit around the periphery of a can and having its small end offset from the large end to assist in pouring.

U.S. Pat. No. 584,275, Inventor: M. N. Sevier, Issued: Jun. 8, 1897.

This United States Patent discloses a combined measure and funnel whereby the funnel after use can be inverted over the container and having a top for placement over the opening of the funnel which allows the material which adhered to the sides of the funnel to drain into the measure while preventing foreign substances from entering such as dust and dirt.

U.S. Pat. No. 5,031,804 Inventor: Donald A. Conrad, Issued: Jul. 16, 1991.

A combination pouring spout and flat lid for attachment to the top of a viscous liquid container, including a short, conically-shaped pouring spout having a narrow diameter upper end and a wider diameter lower end allowing it to pass upward through an aperture formed in the flat lid for fixable engagement therewith, a flange extending outward about the lower end of the spout containing construction for absorbing shock from use of the spout and from extraneous impacts thereagainst, an aimular planar mating surface formed on the upper portion of the flange for contact with the underside of the lid, a constricted throat portion formed in the spout having a swollen, ring-shaped portion formed in the spout above the throat of an outside diameter slightly greater than the diameter of the aperture and an upwardly and inwardly slanted outer surface formed about the ring-shaped portion for centering the ring-shaped portion in the aperture to bring the mating surface into contact with the lid and lock the spout firmly in the aperture.

U.S. Pat. No. 3,596,813, Inventor: Elvin R. Munn, Issued: Aug. 3, 1971.

A ready to use paint pourer is offered as a practical aid when the user desires to pour paint from one container into another container in a spillproof manner. Each of the two forms herein shown comprises a self-contained moldable plastic attachment characterized by an auxiliary lid which is brought into use after the regular closing lid has been pried loose and removed from the keying channel of the annular mounting rim. This auxiliary or replacement lid has (1) a suitable spout and (2) marginal attaching and retaining means having a web whose outer peripheral edge is provided with an inverted channel-shaped adapter capable of being conformingly snapped over the rim's securing bead.

U.S. Pat. No. 4,009,802, Inventor: Leon Hayduchok, Issued: Mar. 1, 1977,

A semiannular paint can attachment combines brush scraping means with a shallow cavity for catching and retaining the paint drippings tip to a certain level above which the excess returns to the can through an internal opening. A pouring lip partially surrounds the opening, functioning in a dual capacity as a scraper for the brush, and to prevent paint poured from the can from dripping over the sides of the can.

U.S. Pat. NO. 5,803,140, Inventor: David Edward Jodoin, Issued: Sep. 8, 1998.

An oil drain funnel for removable attachment to the bottom of an engine oil pan for receiving oil draining therefrom having a magnetic retention device on the rim of the opening for receiving fluids thereunto, and a cross member supported by the sidewall of the funnel and spanning the entrance to the opening of the outlet of the funnel to prevent the passage of the oil pan drain plug therethrough while allowing the flow of oil through the outlet.

While these funnel devices may be suitable for the purposes for which they were designed, they would not be as suitable for the purposes of the present invention, as hereinafter described.

SUMMARY OF THE PRESENT INVENTION

The present invention discloses a detachable funnel for attachment to the top of a conventional paint can. The funnel has an elongated neck being offset from center having a threadably attached top on its orifice end. The top has an auxiliary attachment to the neck by a ring having a lead connecting the top thereto. A tab is provided on the neck to which the top can be attached when not in use. The base of the funnel has a lip member thereon having a contoured downwardly extending protrusion thereon for mating with the locking groove of the paint can top. An alternative funnel is disclosed having a centrally positioned, shortened neck.

A primary object of the present invention is to provide a funnel device which attaches to the top of a paint can to aid in the pouring of paint therefrom.

Another object of the present invention is to provide a funnel device having an annular opening which conforms substantially to the annular opening of a paint can.

Yet another object of the present invention is to provide a funnel device having threaded closure means for preventing the contents from drying out or from foreign particles from entering the container, as well as, preventing spillage should the container fall over.

Still yet another object of the present invention is to provide a funnel device which has means for retaining the top when the cap is unscrewed from the funnel.

Yet another object of the present invention is to provide a funnel device having a lid retainer molded onto the exterior of the funnel providing means for anchoring the top while it is not being used.

Another object of the present invention is to provide a funnel device having a steel ring embedded into the can engaging rim of the funnel which will maintain the shape after repeated use, as well as, extend the life of the funnel.

Additional objects of the present invention will appear as the description proceeds.

The present invention overcomes the shortcomings of the prior art by providing a funnel shaped attachment for paint cans having a rim for engaging the key groove of a paint can and having a steel ring embedded within the periphery edge of the cover portion of the funnel. Further said funnel having an external spiral thread around the throat of the funnel orifice providing engaging means for the threaded sealing means and said threaded scaling means having retaining means to prevent loss of the sealing means. In addition, said funnel having positioning means for engaging the sealing means while the funnel is in use. Further the orifice formed by the engaging lip of the funnel has the substantially identical diameter as that of the orifice formed by the groove of the can whereby the two orifices, being identical, seal the mating surfaces, preventing paint from entering said seal thereby when the paint is poured from the can using the funnel the paint which adhered to the sides of the funnel will drip back into the paint can.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

List of Reference Numerals

Figure 1:
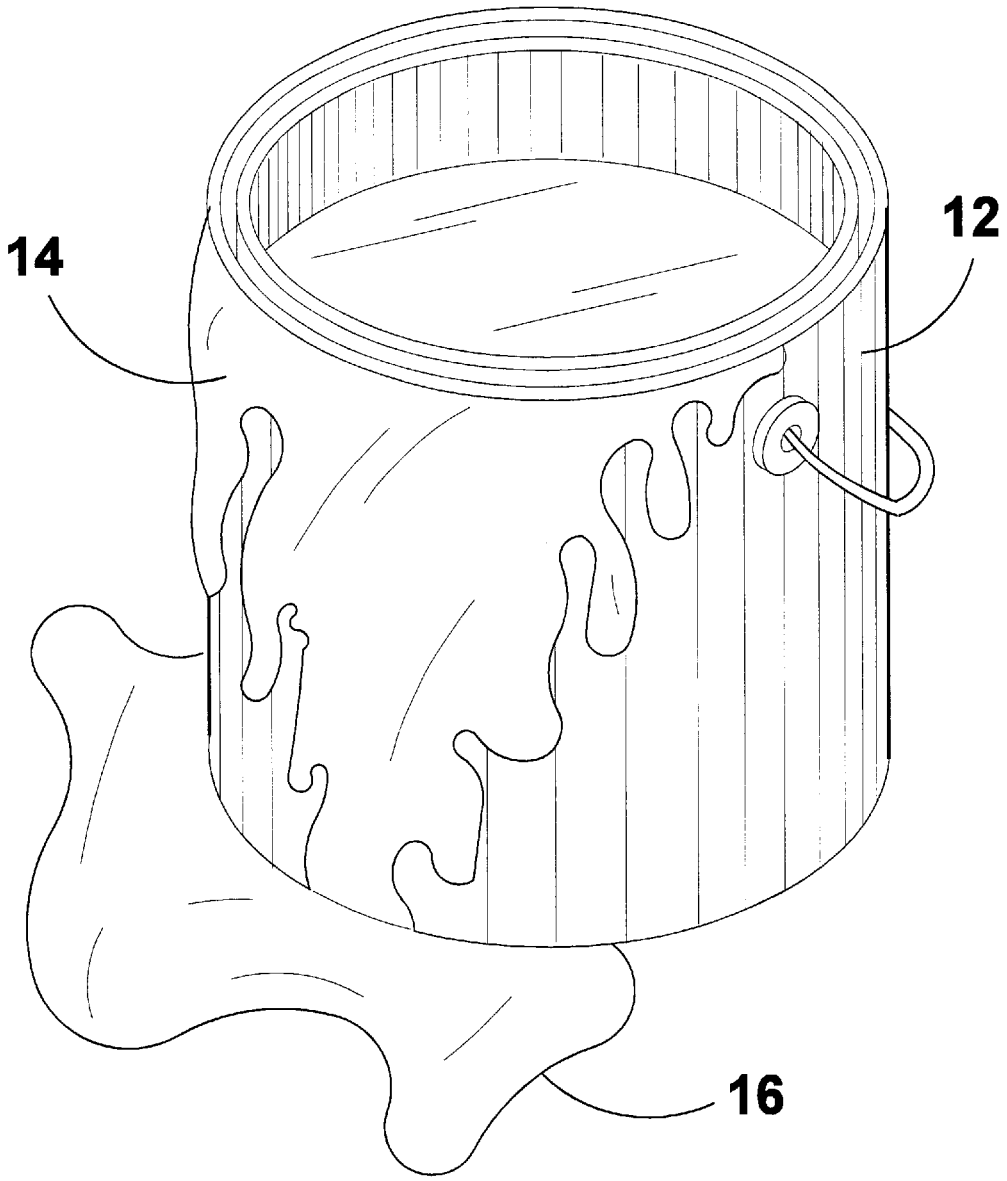
PRIOR ART FIG 1
FIG. 1 is an illustrative view of the prior art wherein a paint can usually has paint on the exterior can which run onto the floor. The present invention would prevent this situation.

With regard to reference numerals used, the following numbering is used throughout the drawings.

| | |
|---|---|
| 10 | present invention |
| 12 | paint can |
| 14 | paint |
| 16 | floor |
| 18 | hands |
| 20 | elongated neck |
| 22 | closure means |
| 24 | retainer tab |
| 26 | funnel rim |
| 28 | threads |
| 30 | neck ring |
| 32 | lead |
| 34 | steel ring |
| 35 | interior |
| 36 | cap recess |
| 38 | funnel neck lip |
| 39 | funnel opening |
| 40 | funnel base protrusion |
| 42 | locking groove of paint can |
| 44 | short neck |
| 46 | central orifice |
| 48 | cavity |

DESCRIPTION OF THE PREFERRED EMBODIMENT(S)

In order that the invention may be more fully understood, it will now be described, by way of example, with reference to the accompanying drawings in which FIGS. 1 through 11 illustrate the present invention being a funnel attachment for a conventional paint can.

Turning to FIG. 1, shown therein is an illustrative view of the prior art wherein a conventional paint can 12 usually has paint on the exterior of the can which can run onto the floor 16. The present invention would prevent this situation.

Figure 2:
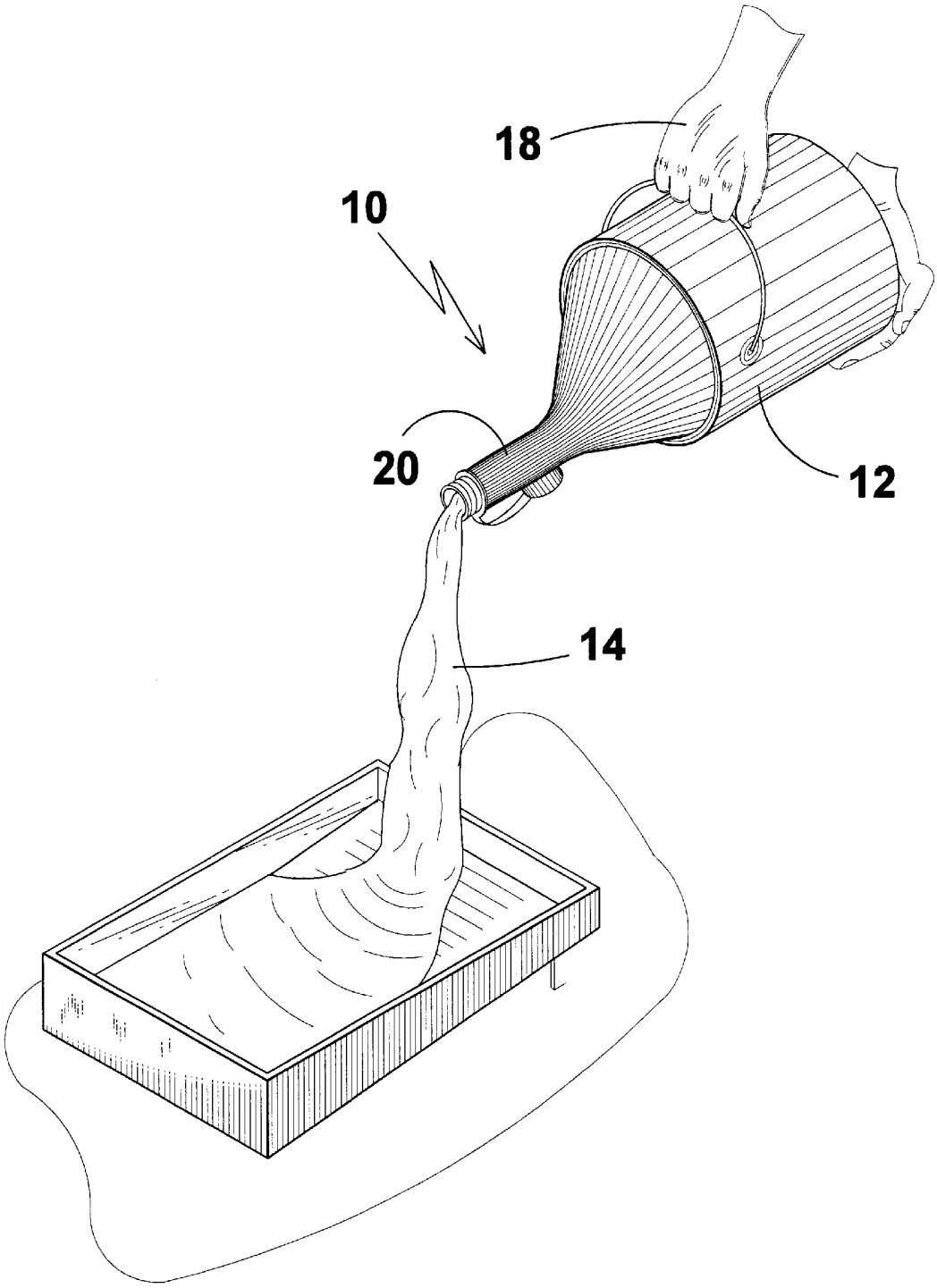
FIG. 2 is an illustrative view of the preferred embodiment of the present invention in use. Shown is a paint can having the funnel device attached. The funnel having an elongated neck portion and being offset to one side extends the point at which the paint leaves the can thereby giving the user better visibility and control over the amount of paint dispensed.

Turning to FIG. 2, shown therein is an illustrative view of the preferred embodiment of the present invention 10 in use. Shown is a conventional paint can 12 in the hands 18 of the user having the funnel device 10 attached thereto. The funnel 10 has an elongated neck portion 20 and being offset from the center to one side extends the point at which the paint 14 leaves the can 12 thereby giving the user better visibility and control over the amount of paint 14 dispensed.

Figure 3:
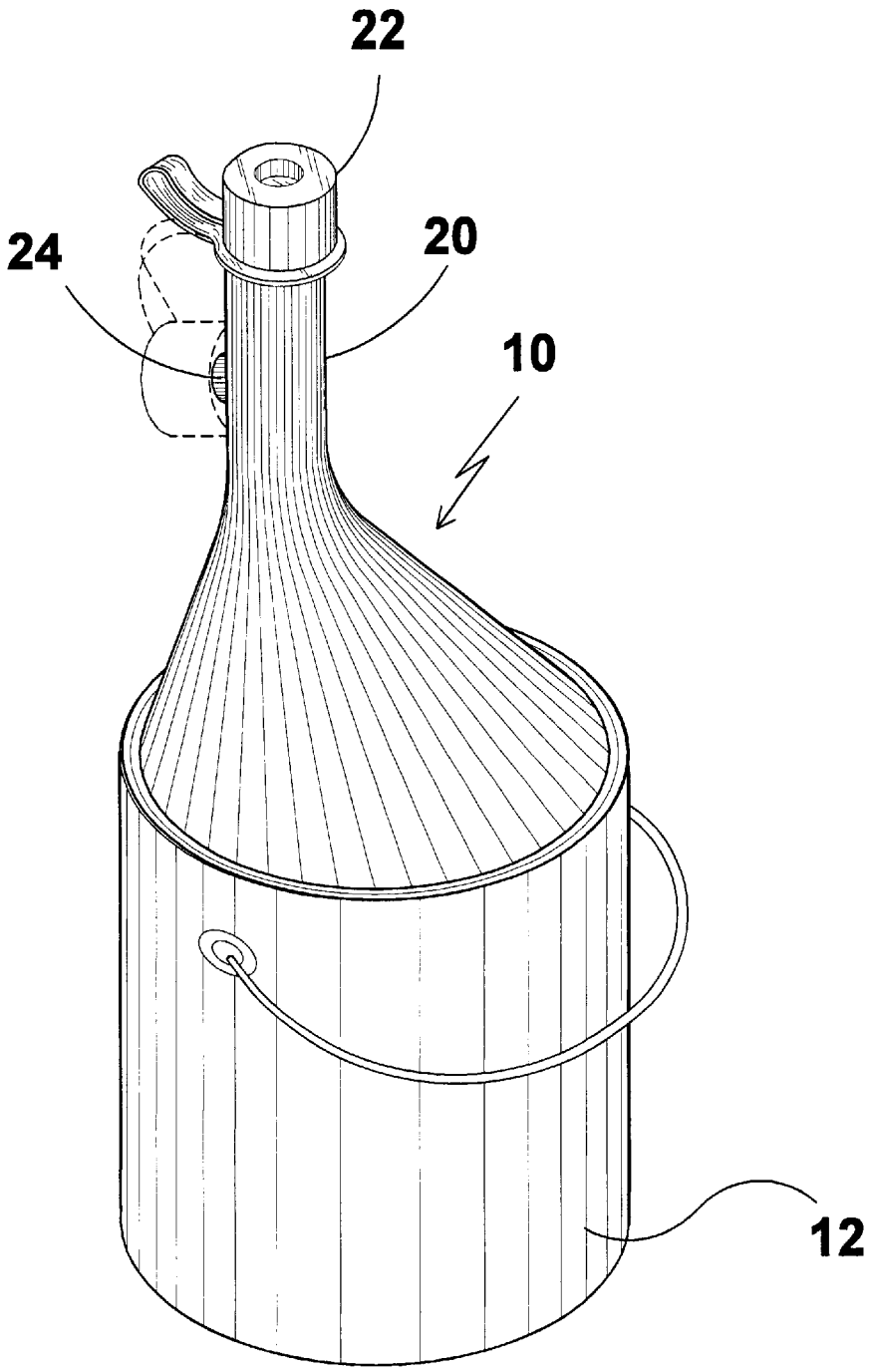
FIG. 3 is a perspective view of the preferred embodiment of the present invention attached to a paint can. Shown is the funnel having an elongated offset neck and having closure means to prevent the contents from drying out, even during storage with the funnel attached. The funnel also has a tab located on the wall of the funnel where the top can be anchored. This will keep the top out of the way while the funnel is being used.

Turning to FIG. 3, shown therein is a perspective view of the preferred embodiment of the present invention 10 attached to a paint can 12. Shown is the funnel 10 having an elongated offset neck 20 and having closure means 22 to prevent the contents from drying out, even during storage with the funnel 10 attached to the can. The funnel 10 also has a tab 24 located on the wall of the funnel 10 where the top 22 can be anchored. This will keep the top 22 out of the way while the funnel 10 is being used.

Figure 4:
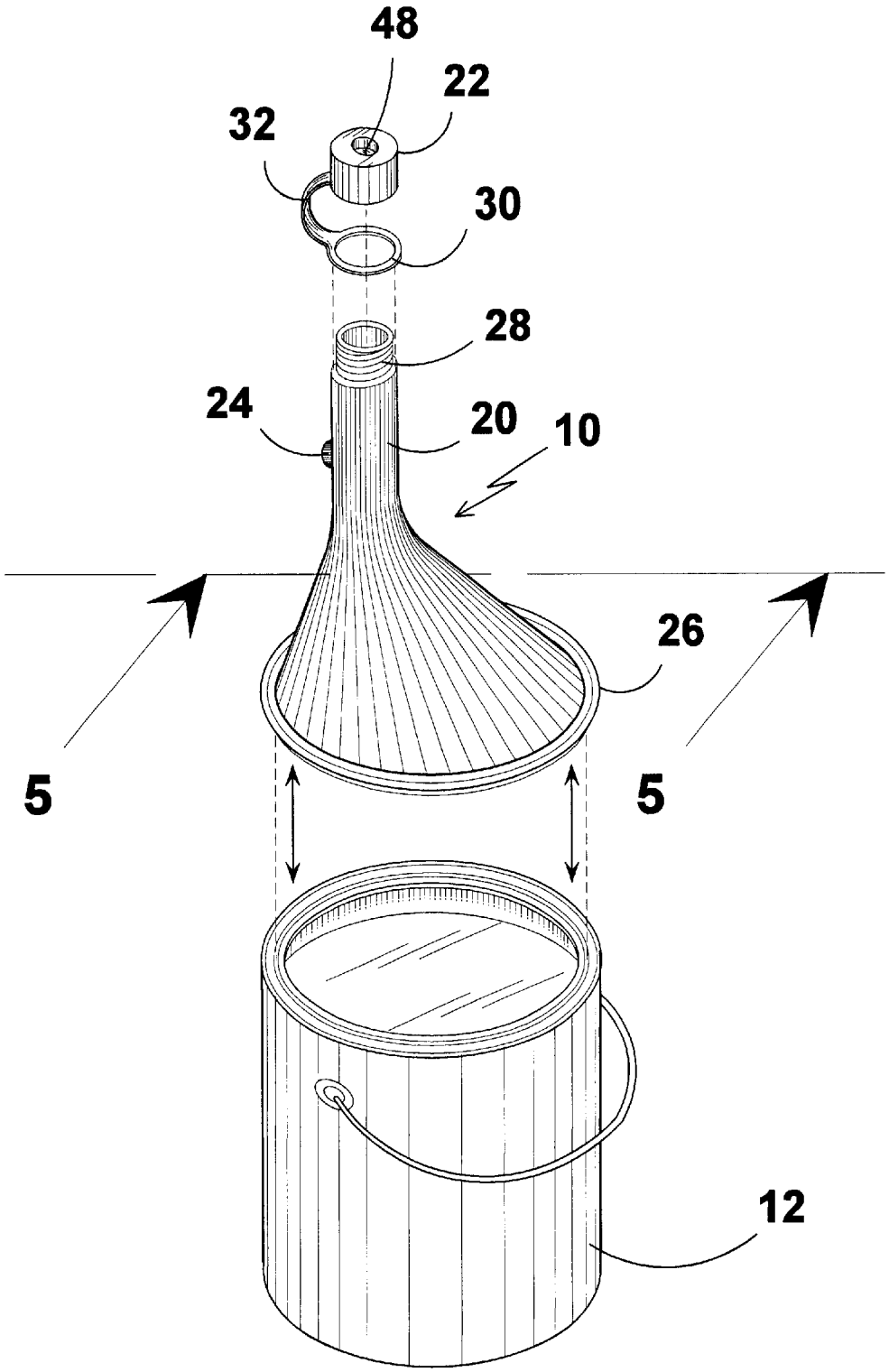
FIG. 4 is a perspective view of the preferred embodiment of the present invention positioned over a typical paint can. The funnel has a rim which fits onto the paint can. The funnel has an extended offset throat member having threads for securely attaching a cap. The cap has a retaining ring attached by a lead which is long enough to allow the cap to be anchored onto the tab.

Turning to FIG. 4, shown therein is a perspective view of the preferred embodiment of the present invention 10 positioned over a typical paint can 12. The funnel 10 has a rim 26 which fits onto the paint can 12 top. The funnel has an extended offset throat 20 member having external threads 28 for securely attaching a cap 22. The cap has a retaining ring 30 attached by a lead 32 which is long enough to allow the cap 22 to be anchored onto the tab 24 and a cavity 48 on its unthreaded end for attachment to tab 24.

Figure 5:
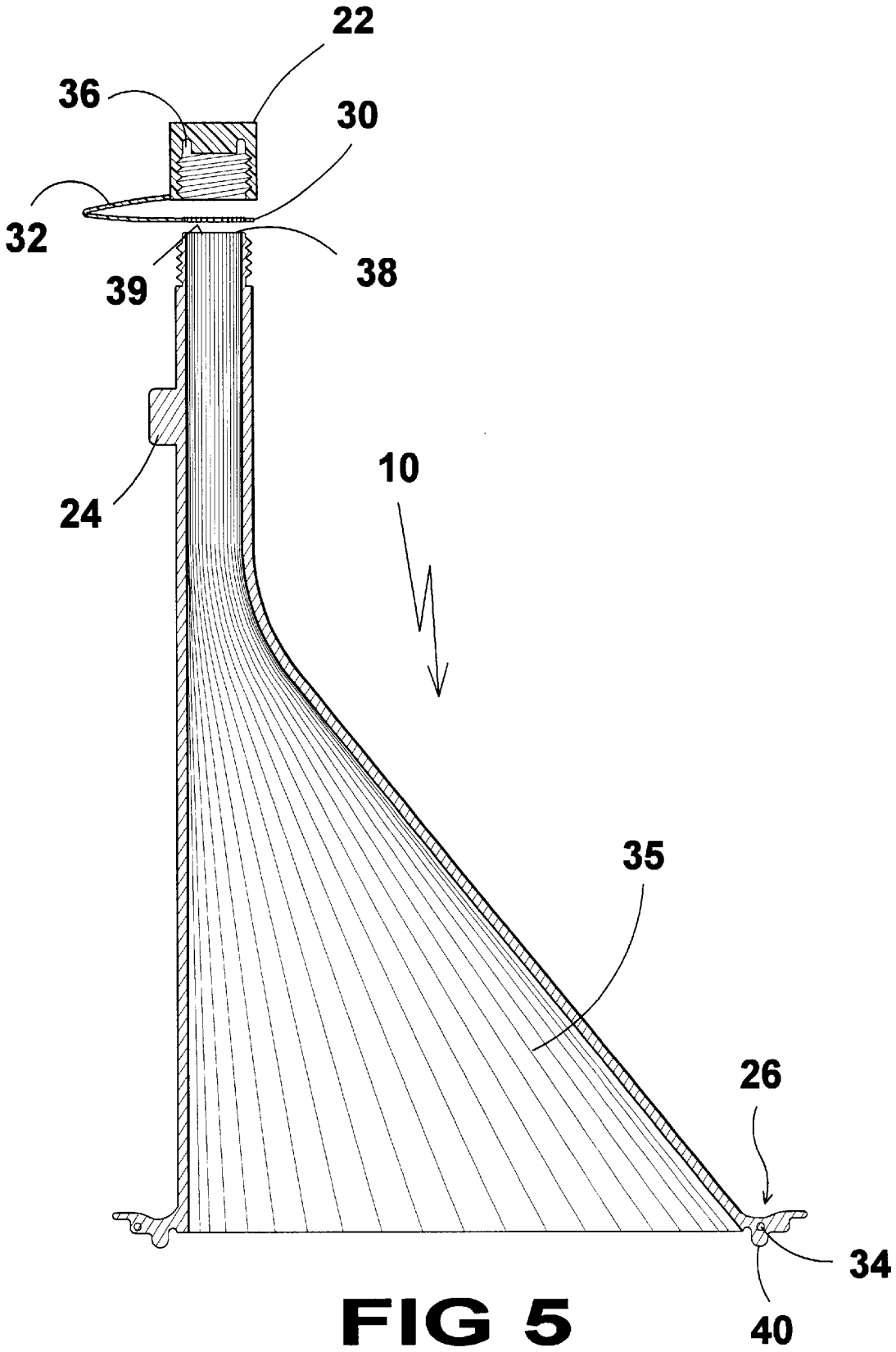
FIG. 5 is a cross sectional view of the present invention taken from FIG. 4 as indicated. Shown is the interior of the funnel and screw on top. The can engaging portion of the funnel has a lip which fits into the lid locking groove of the can. Also shown is a steel ring which will maintain and strengthened the lip of the funnel. The funnel also has a tab molded onto the side for anchoring the top out of the way while using the funnel. The cap has a mating recess for the lip of the small annular opening of the funnel which will prevent air from entering. As well as a lead attached to a ring to prevent loss of the cap.

Turning to FIG. 5, shown therein is a cross sectional view of the present invention 10 taken from FIG. 4 as indicated. Shown is the interior 35 of the funnel 10 and screw on top 22. The can engaging portion of the funnel 10 has a downwardly extending protrusion 40 on the underside of funnel rim 26 which fits into the lid locking groove of the can. Also shown is a steel ring 34 embedded internally in lip 26 which will maintain and strengthened the lip 26 of the funnel 10. The funnel 10 also has a tab 24 molded onto the side for anchoring the top 22 out of the way while using the funnel 10. The cap 22 has a mating recess 36 for the lip 38 of the small annular opening 39 for sealing of the funnel 10 which will prevent air from entering the paint can in storage as well as a lead 32 attached to a ring 30 to prevent loss of the cap 22.

Figure 6:
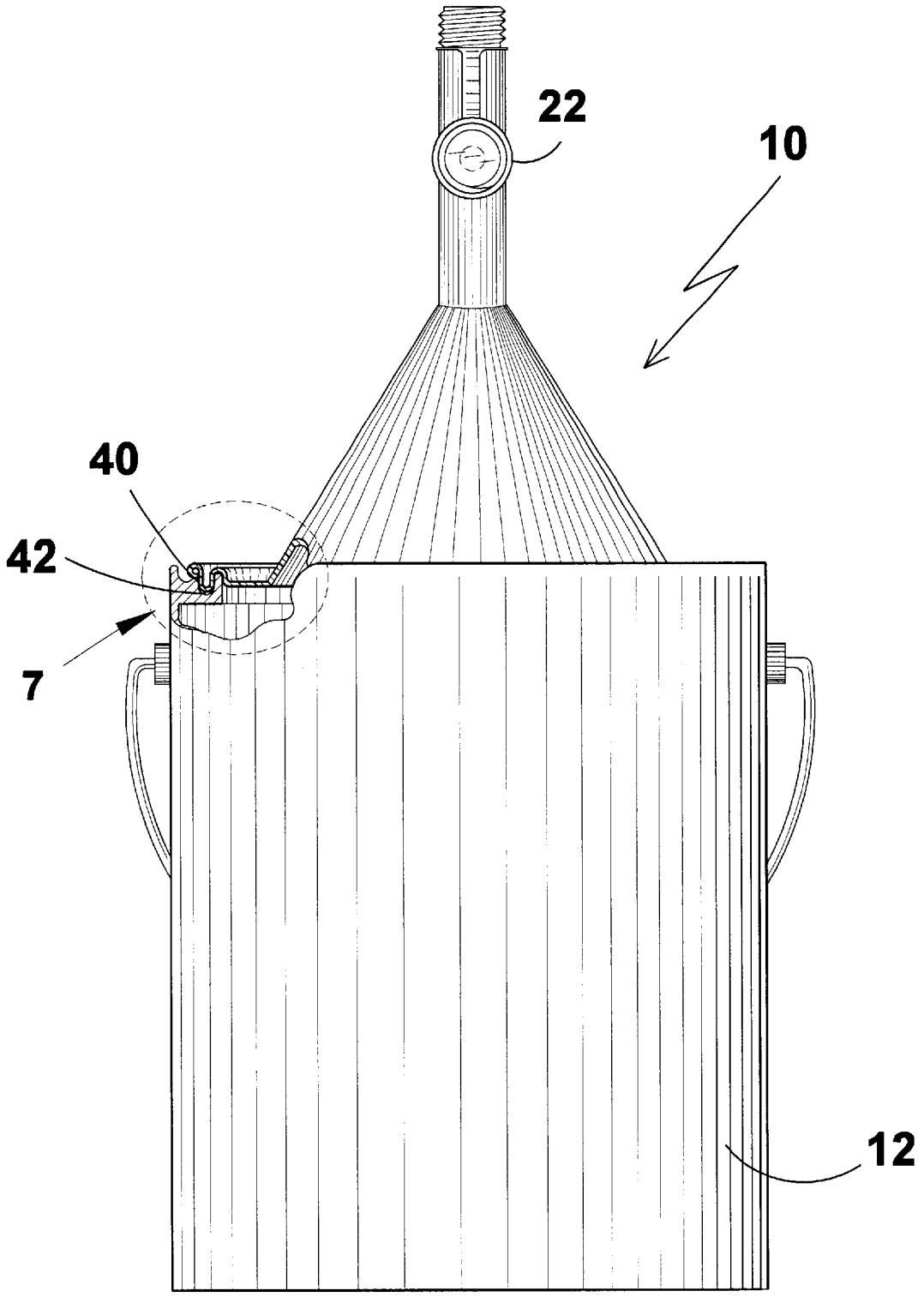
FIG. 6 is a front view of the funnel attached to a typical paint can with the top removed. Shown is the funnel having a mating lip portion which is inserted into the keyed locking groove of the paint can.

Turning to FIG. 6, shown therein is a front view of the funnel 10 attached to a typical paint can 12 with the top 22 removed. Shown is the funnel 10 having a mating protrusion 40 portion which is inserted into the keyed locking groove 42 of the paint can 12.

Figure 7:
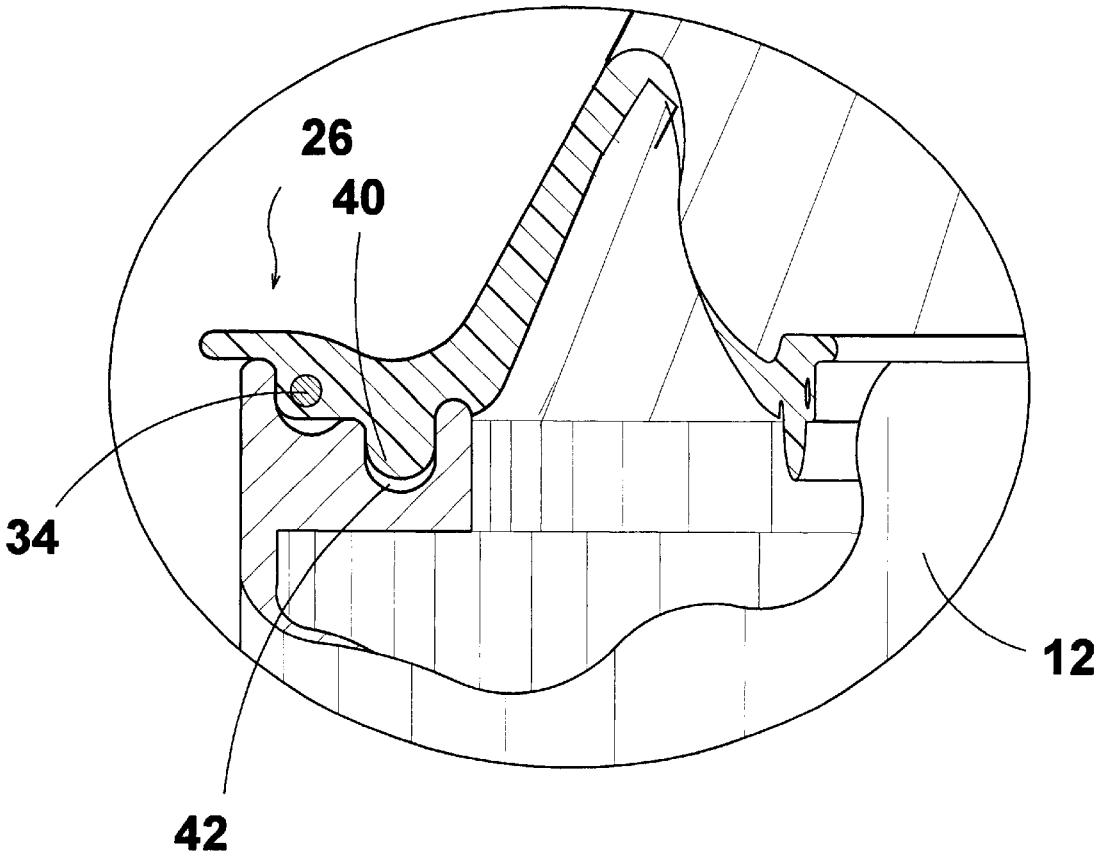
FIG. 7 is an enlarged view of the retaining means of the funnel to the paint can, taken from FIG. 6 as indicated. Shown is the lip of the funnel having a circular protrusion which mates with the keyed groove of the can. The lip also has an embedded metal ring which maintains the form of the funnel, as well as, extending the life of the funnel.

Turning to FIG. 7, shown therein is an enlarged view of the retaining means of the funnel 10 to the paint can 12, taken from FIG. 6 as indicated. Shown is the protrusion 40 of the funnel rim 26 being a circular protrusion which fixedly mates with the keyed groove 42 of the can 12. The lip 26 also has an embedded metal ring 34 which maintains the form of the funnel, as well as, extending the life of the funnel rim 26.

Figure 8:
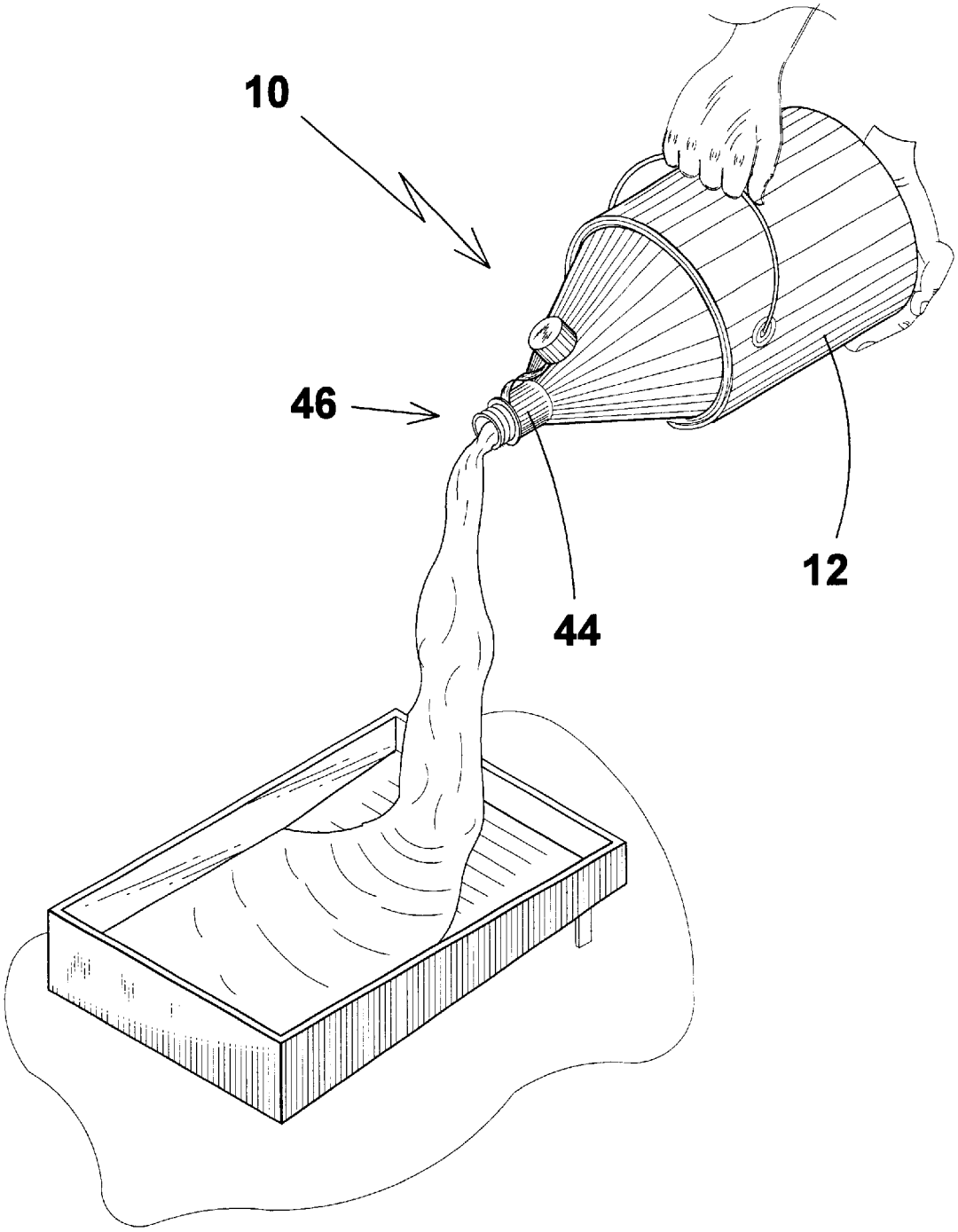
FIG. 8 is an illustrative view of a variation of the location and length of the neck member of the present invention in use. Shown is a paint can having a funnel device having a short neck member with a centrally located orifice.

Turning to FIG. 8, shown therein is an illustrative view of a variation of the location and length of the neck member 44 of the present invention 10 in use. Shown is a paint can 12 having a funnel device 10 having a short neck member 44 about one inch to two inches in length with a centrally located orifice 46.

Figure 9:
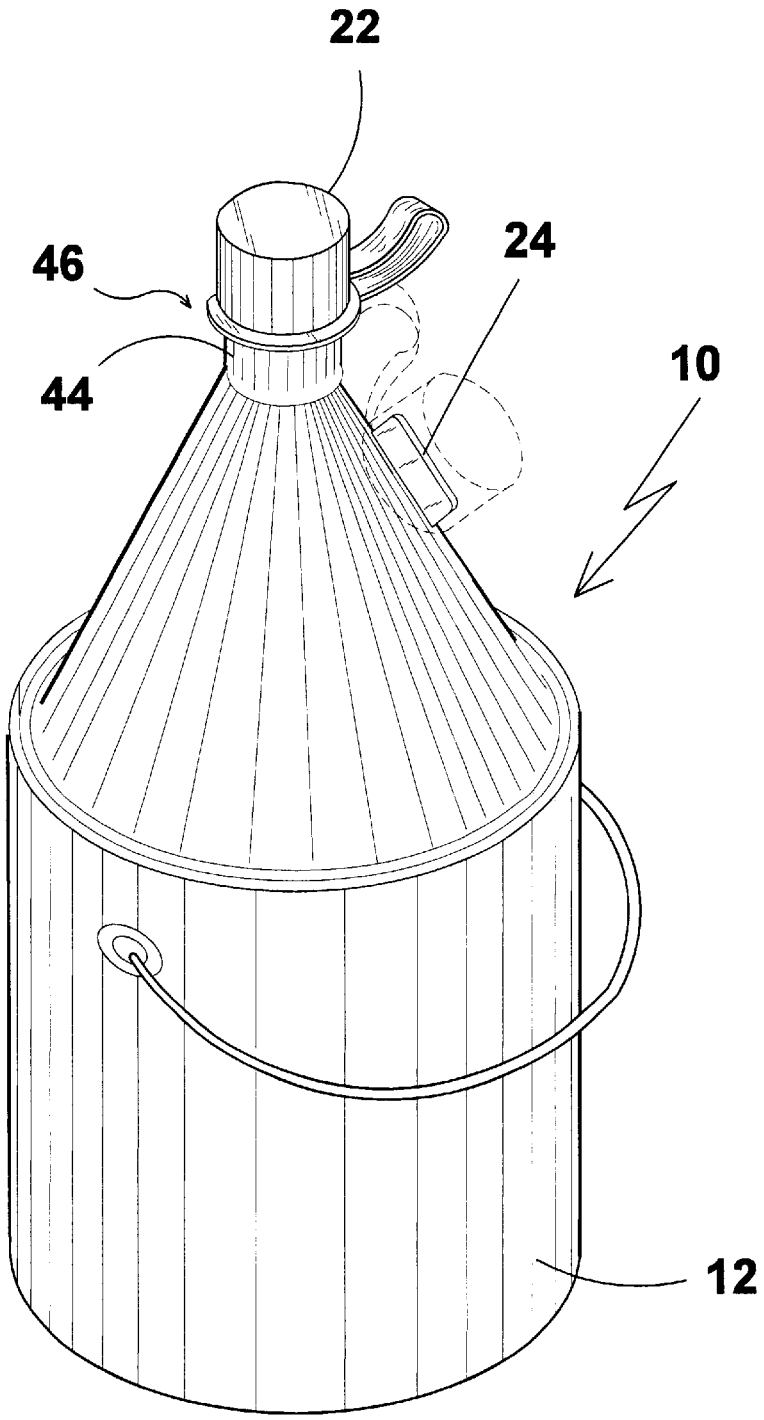
FIG. 9 is a perspective view of a variation of the location and length of the neck member of the present invention attached to a paint can. Shown is the funnel having a small centrally located orifice having closure means to prevent the contents from drying out, even during storage with the funnel attached. The funnel also has a tab located on the wall of the funnel where the top can be anchored. This will keep the top out of the way while the funnel is being used.

Turning to FIG. 9, shown therein is a perspective view of a variation of the location and length of the neck member 44 of the present invention 10 attached to a paint can 12. Shown is the funnel 10 having a small centrally located orifice 46 having closure means 22 to prevent the contents from drying out, even during storage with the funnel 10 attached. The funnel also has a tab 24 located on the wall of the funnel 10 where the top 22 can be anchored. This will keep the top 22 out of the way while the funnel 10 is being used.

Figure 10:
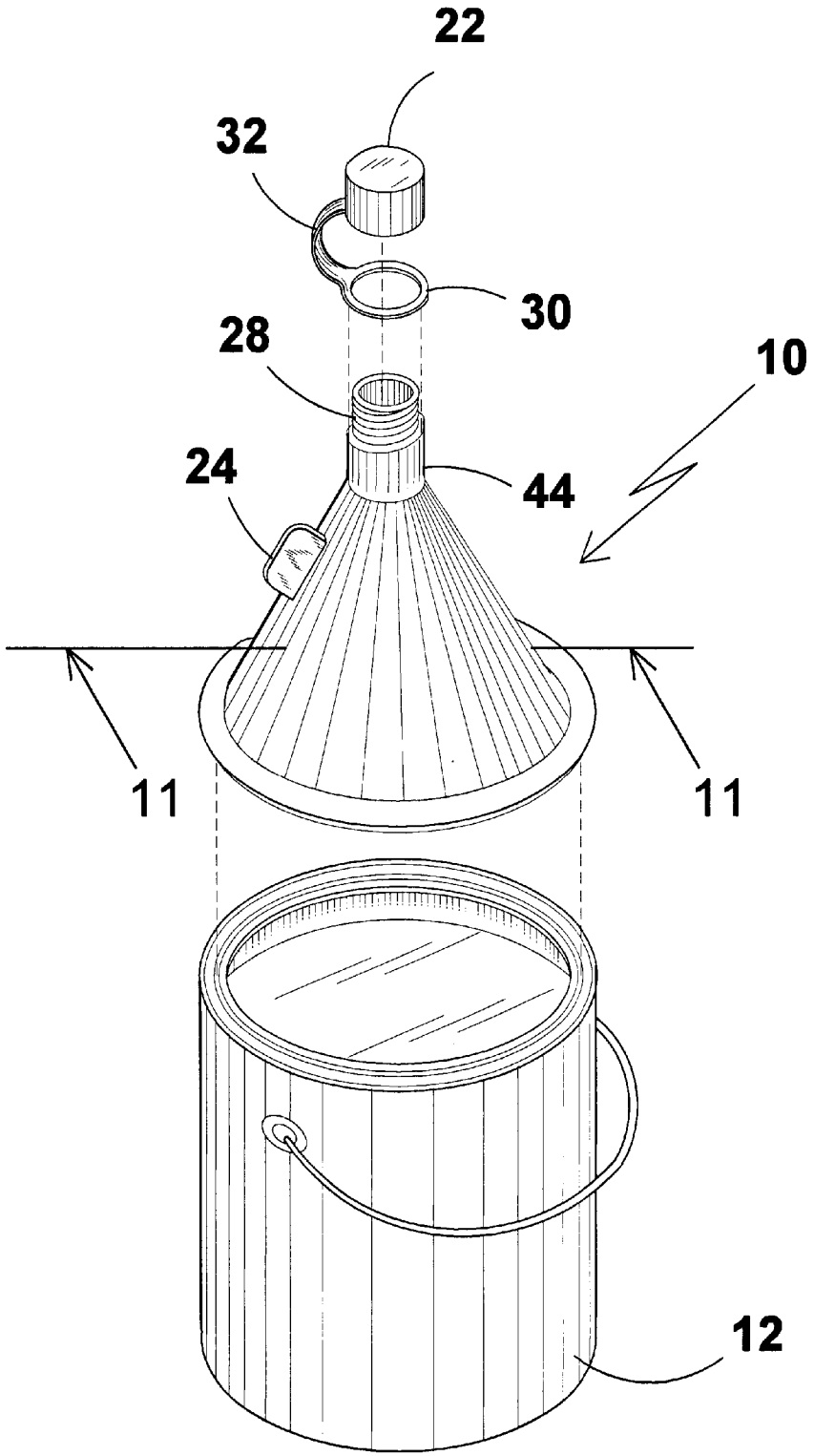
FIG. 10 is a perspective view of the variation of the location and length of the neck member of the present invention positioned over a typical paint can. The funnel has threads for securely attaching a top. The top has a retaining ring attached by a lead which is long enough to allow the top to be anchored onto the tab.

Turning to FIG. 10, shown therein is a perspective view of the variation of the location and length of the neck member 44 of the present invention 10 positioned over a typical paint can 12. The funnel has threads 28 for securely attaching a top 22. The top 22 has a retaining ring 30 attached by a lead 32 which is long enough to allow the top 22 to be anchored onto the tab 24.

Figure 11:
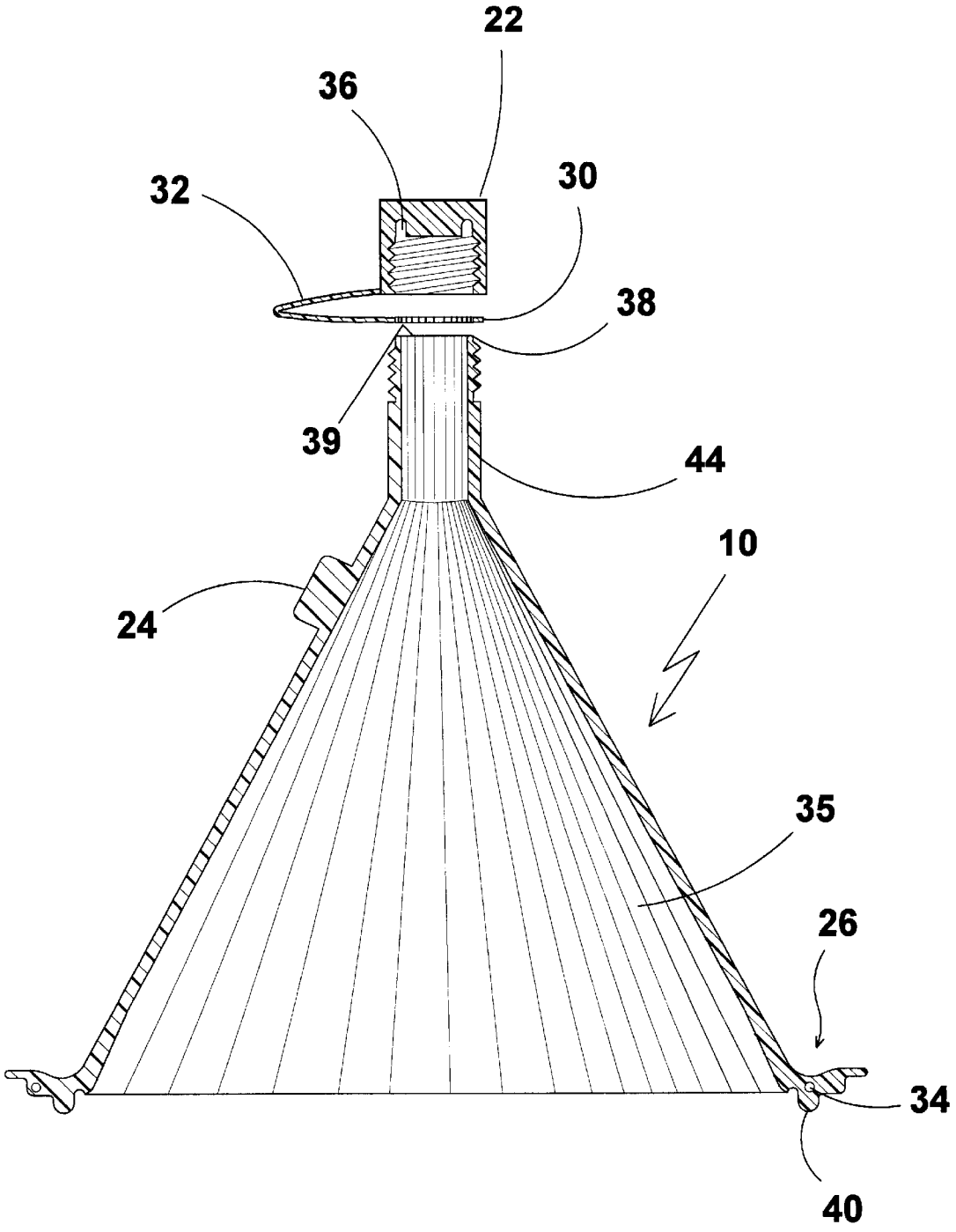
FIG. 11 is a cross sectional view of the variation of the location and length of the neck member of the present invention taken from FIG. 10 as indicated. Shown is the interior of the funnel and screw on top. The can-engaging portion of the funnel has a lip which fits into the lid locking groove of the can. Also shown is a steel ring which will maintain and strengthened the lip of the funnel. The funnel also has a tab molded onto the side for anchoring the top out of the way while using the funnel. The cap has a mating recess for the lip of the small annular opening of the funnel which will prevent air from entering. As well as a lead attached to a ring to prevent loss of the cap.

Turning to FIG. 11, shown therein is a cross sectional view of the variation of the location and length of the neck member 44 of the present invention 10 taken from FIG. 10 as indicated. Shown is the interior 35 of the funnel 10 and screw on top 22. The can engaging portion of the funnel has a protrusion 40 of the funnel rim 26 which fits into the lid locking groove 42 (not shown) of the can. Also shown is a steel ring 34 which will maintain and strengthen the lip 26 of the funnel 10. The funnel 10 also has a tab 24 molded onto the side for anchoring the top 22 out of the way while using the funnel 10. The cap 22 has a mating recess 36 for the lip 38 of the small annular opening 39 of the funnel 10 which will prevent air from entering as well as a lead 32 attached to a ring 30 to prevent loss of the cap 22.

What is claimed to be new and desired to be protected by Letters Patent is set forth in the appended claims:

1. An apparatus for a funnel attachment to a conventional paint can:

a) a funnel-shaped member having an inlet end and an outlet end, said funnel-shaped member having a base for attachment to the conventional paint can;

b) an elongated neck on said funnel-shaped member;

c) said elongated neck being disposed off-center;

d) a closure means disposed on said outlet end of said funnel-shaped member; and, e) an attachment means for attaching said base of said funnel-shaped member to the conventional paint can;

f) said closure means further comprising a female threaded cap;

g) said elongated neck further comprising mating male threads on said outlet end for receiving said female threaded cap;

h) said cap further comprising a retaining ring attached to said elongated neck for securing said cap to said neck when said cap is not threaded onto said elongated neck and a lead for connecting said cap to said retaining ring; and i) a tab disposed on the outer wall of said elongated neck, said tab for receiving said cap whereby said cap is secured to said tab.

2. The apparatus of claim 1, said cap having a cavity therein for receiving said tab internal said cavity, whereby said cap is secured to said tab.

3. The apparatus of claim 2, said cap further comprising a recess therein, said recess disposed on the inside of the unthreaded end of said cap, said recess for receiving the lip of the outlet orifice of said elongated neck whereby said cap is sealed to said elongated neck.

* * * * *